United States Patent [19]

Mishcon et al.

[11] 4,020,653

[45] May 3, 1977

[54] SINKER TOP CIRCULAR KNITTING MACHINE FOR PRODUCING LOOP FABRIC

[75] Inventors: Lester Mishcon, Miami Beach; Donald William Reagan, Hialeah, both of Fla.

[73] Assignee: The Singer Company, New York, N.Y.

[22] Filed: Feb. 10, 1976

[21] Appl. No.: 656,779

[52] U.S. Cl. ..... 66/93; 66/107

[51] Int. Cl.[2] ..... D04B 27/04

[58] Field of Search ..... 66/104, 107, 108 A, 66/114, 115, 8, 194, 108 R, 93

[56] References Cited

UNITED STATES PATENTS

| | | | |
|---|---|---|---|
| 1,560,352 | 11/1925 | Sheppard | 66/107 |
| 2,080,377 | 5/1937 | Nebel | 66/93 |
| 2,120,796 | 6/1938 | Coile | 66/8 X |
| 2,135,187 | 11/1938 | Lawson et al. | 66/115 |
| 2,436,904 | 3/1948 | Shea | 66/93 X |
| 2,662,383 | 12/1953 | Lombardi | 66/107 X |
| 2,893,226 | 7/1959 | Lombardi | 66/93 |
| 3,149,483 | 9/1964 | Mishcon | 66/107 |
| 3,209,557 | 10/1965 | Lagerweij | 66/108 A |
| 3,221,521 | 12/1965 | Mishcon | 66/107 |
| 3,254,509 | 6/1966 | Tenconi | 66/108 R X |

FOREIGN PATENTS OR APPLICATIONS

| | | | |
|---|---|---|---|
| 46-15141 | 4/1971 | Japan | 66/93 |
| 1,247,625 | 9/1971 | United Kingdom | 66/93 |

*Primary Examiner*—Louis K. Rimrodt
*Assistant Examiner*—A. M. Falik
*Attorney, Agent, or Firm*—Edward L. Bell; Robert E. Smith; William V. Ebs

[57] ABSTRACT

A circular knitting machine for producing loop fabric is provided with fabric holding means and with sinkers peculiarly adapted to enter and hold previously formed loops during the knitting process.

8 Claims, 9 Drawing Figures

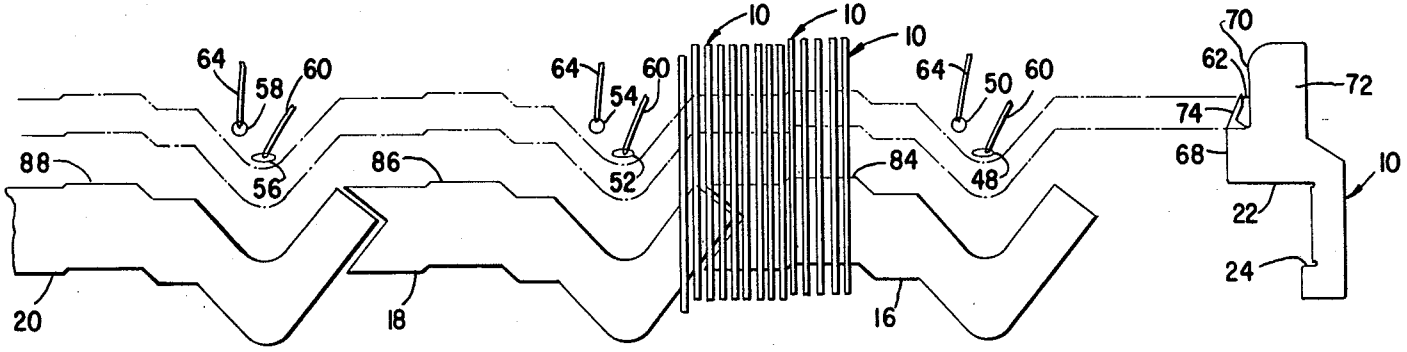
Fig. 1
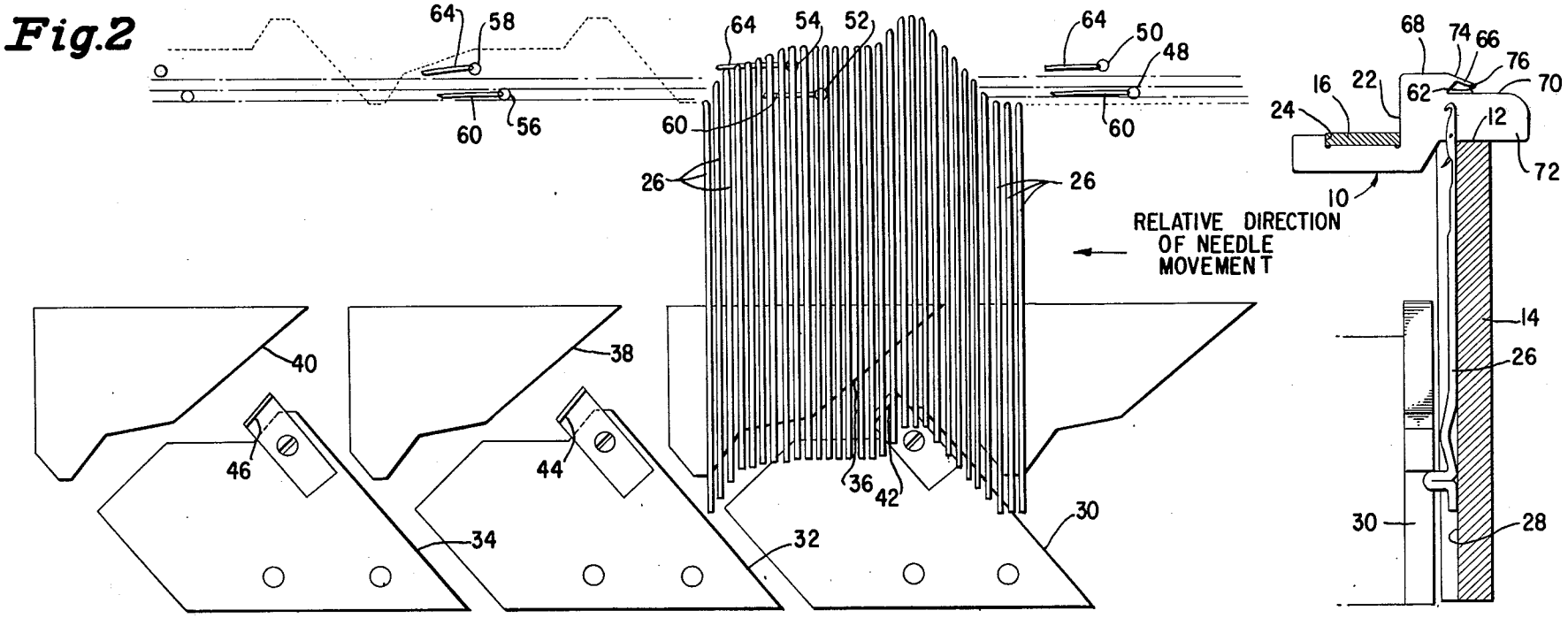
Fig. 2
Fig. 3

Fig. 6
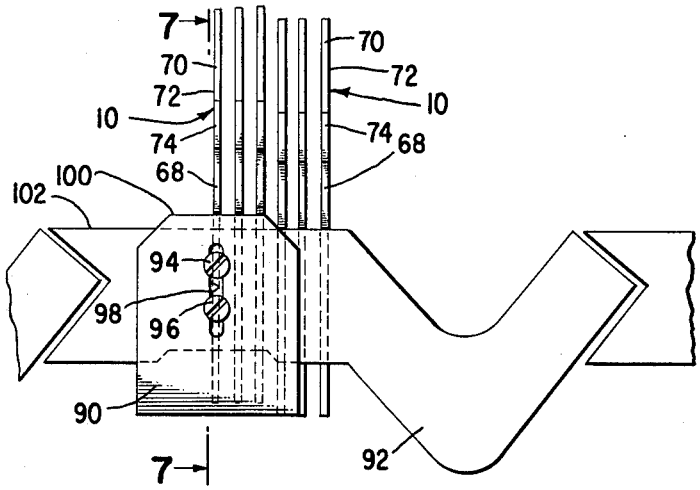
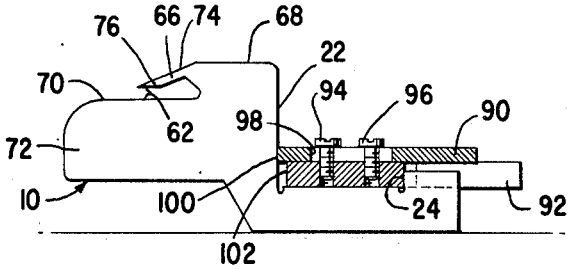
Fig. 7
Fig. 8
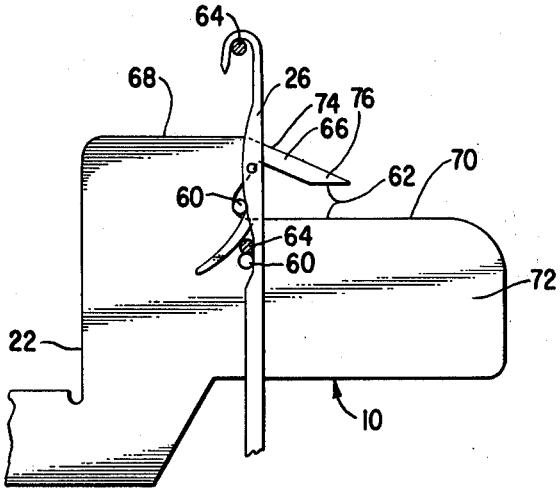
Fig. 9
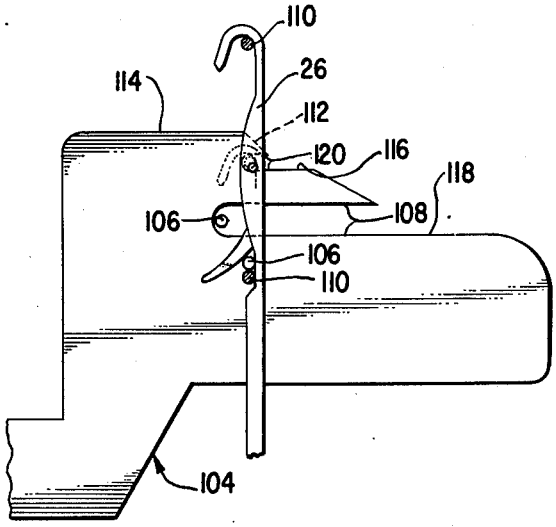

SINKER TOP CIRCULAR KNITTING MACHINE FOR PRODUCING LOOP FABRIC

BACKGROUND OF THE INVENTION

1. Field of the Invention

The invention relates to circular knitting machines and more particularly to sinker top circular knitting machines adapted to produce loop fabric.

2. Description of the Prior Art

Sinker top circular knitting machines capable of producing loop fabric are well known in the knitting industry. In such machines the sinkers generally include a blade having an upper edge which defines a lower knitting level and a nib having an upper edge which is at an upper knitting level. Long loops are formed at the upper knitting level of the sinkers with a loop yarn, and a base yarn is knitted over the blade. The sinkers may be formed and their movement controlled to cause either the loop yarn to appear on one side of a fabric and the base yarn on the other (regular plating), or the loop yarn to appear on both sides (reverse plating).

In the past it has not been possible to produce loop cloth of ideal quality since loops would twist or coil making it difficult to finish a loop fabric into a satisfactory velour. Furthermore loops which were supposed to appear on the front of a fabric would sometimes appear on the other side. The back of loop cloth was therefore apt to have objectionable loose protruding loops and double tuck stitches.

SUMMARY OF THE INVENTION

In order to overcome the difficulties encountered in the past in producing loop cloth of desired quality a technique has been devised for mechanically controlling loop yarns in a circular knitting machine through two or more successive feeds in such fashion as to cause a loop fabric to be formed with untwisted uniformly sized loops on one side of the cloth and a clean back on the other side. In accordance with the invention, sinkers having an upper knitting level on which loops are formed and having a lower knitting level on which a base yarn is knit are each formed with a nib extending downwardly from the upper knitting level. Means are provided for holding fabric being knitted above the lower knitting level and loops released from the sinkers are picked up again by the nibs of the sinkers, stretched out, straightened and held during the formation of a new loop. The sinkers are fashioned and their movement controlled for either regular or reverse plating.

DESCRIPTION OF THE DRAWINGS

FIG. 1 is a semidiagrammatic developed top plan view illustrating sinker movements and sinker actuating camming in a machine according to the invention;

FIG. 2 is a semidiagrammatic developed elevational view aligned with FIG. 1 illustrating needle movements and needle actuating camming;

FIG. 3 is a sectional view aligned with FIG. 2 and taken on a radial plane extending through the cylinder of the machine;

FIG. 6 is a semidiagrammatic fragmentary top plan view showing modified sinker actuating camming including retractable reverse plating cam means;

FIG. 7 is a sectional view taken on the plane of the line 7—7 of FIG. 6;

FIG. 8 is an elevational view of a sinker according to the invention for regular plating;

FIG. 9 is an elevational view of a modified form of sinker for reverse plating.

DESCRIPTION OF THE INVENTION

Figure 4:
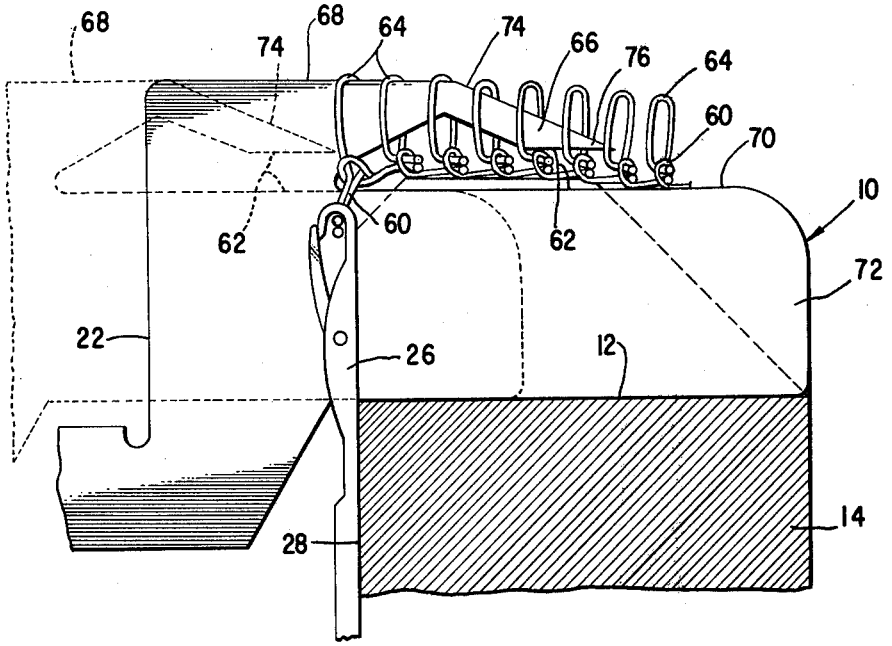
FIG. 4 is an enlarged view taken on a radial plane of the cylinder of the machine and showing a sinker in an extreme inward position in the cylinder in solid lines and in a withdrawn position in dot-dash lines.

Referring to FIGS. 1, 2 and 3, reference character 10 designates sinkers according to the invention slidable in slots 12 in a knitting machine cylinder 14, and reference characters 16, 18, and 20 designate like segments of a cam ring engageable with edges 22 and 24 of the sinkers for positioning the sinkers horizontally relative to cylinder needles 26 during relative rotation of the cylinder and sinker cam ring. The needles 26 are slidable in cylinder slots 28 and alternate between adjacent sinkers around the cylinder. Camming affixed with respect to the sinker cam ring and including like raise cams 30, 32 and 34, like stitch cams 36, 38 and 40 associated with the raise cams 30, 32 and 34 respectively, and like wing cams 42, 44 and 46 affixed to the raise cams 30, 32 and 34 as shown vertically position the needles 26 with respect to the sinkers 10 as the cylinder rotates relative to such cams and the sinker cam ring.

Needles 26 are raised by each of the raise cams 30, 32 and 34 to a latch clear position and then lowered by the associated wing cams 42, 44 and 46 respectively to a tuck position; the raising of the needles to the latch clear position and the lowering to a tuck position both being accomplished while the sinkers 10 are in forward positions with respect to yarn feeding stations 48 and 50, 52 and 54, 56 and 58. The sinkers are then drawn backward toward the outside of the cylinder to permit base yarns 60 to be fed at the level of the sinker throat 62. Loop yarns 64 are fed above sinker nibs 66. The sinkers are moved forward causing the base yarns to be trapped under the sinker nibs and the needles are lowered by the stitch cams 36, 38 and 40 causing the yarns 64 to be formed into long loops over the upper edge 68 of the sinker while the base yarns 60 are knitted over ledge 70 of sinker blade 72.

In accordance with the invention, the sinker nibs 66 are formed with an edge 74 extending downwardly from edge 68 toward ledge 70 of the sinker blade and include a tapered end portion 76 (see FIG. 4). In addition the depth of the slots 12 in which the sinkers slide may be made as shown in FIG. 4 to cause the cylinder 14 to extend above ledge 70 of the blades in the vicinity of the nibs 66 and knitted fabric to be supported by the cylinder at a level higher than that of ledge 70 of the sinker with the nibs formed as described and the fabric supported at the sinkers as indicated, the nibs reenter previously formed long loops of fabric when the sinkers are moved forward (as described) preparatory to the lowering of the needles by stitch cams 36, 38, and 40. Such long loops ride up the sinker nibs during their forward movement. They are stretched out and straightened, and one or more such previously formed long loops is held at the top of the nib while a new long and short loop are formed. The long loops of fabric produced in such manner stand uniformly high and in alignment. Also only long loops of the loop yarn appear on one side of the fabric and only short loops of the base yarn on the other side, there being no loops of either the loop or base yarn which appear on both sides of the fabric.

Figure 5:
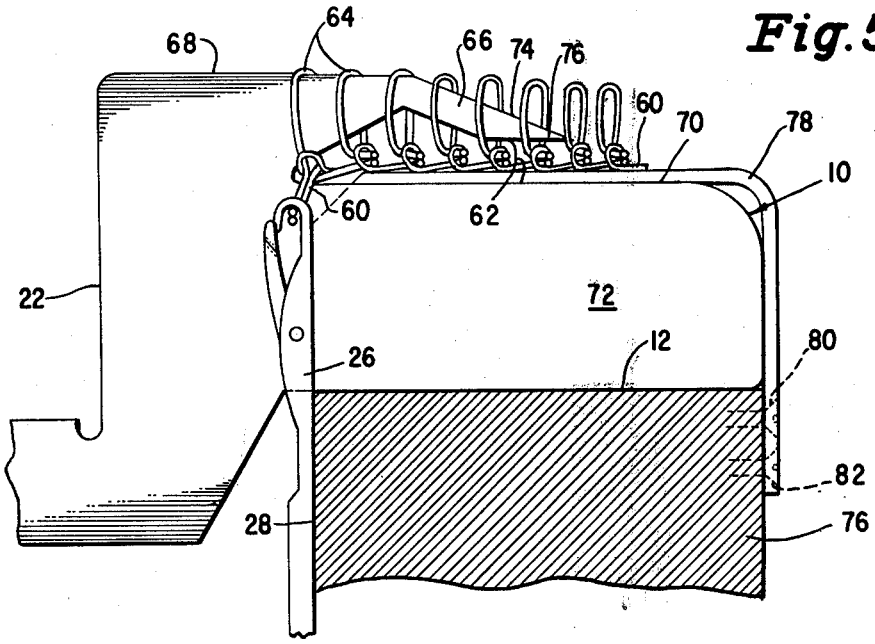
FIG. 5 is a view similar to FIG. 4 showing a modification to the cylinder according to an alternative embodiment of the invention.

Instead of having the depth of the slots 12 in cylinder 14 such as to cause the needle cylinder to support fabric at the sinkers, a needle cylinder 76 with shallower slots not less in depth than the height of the sinker blade 72 may be provided with ring 78 to support the fabric above the level of sinker ledge 70 as shown in FIG. 5. Such ring may be secured to the cylinder 76 in any convenient fashions for example by the counter-sunk screws 80 and 82.

The cam segments 16, 18 and 20 of the cam ring for controlling the movement of sinkers 10 are shown in FIG. 1 as including integral portions 84, 86 and 88 respectively, the purpose of which is to cause the sinkers 10 to engage the base yarns 60 at the end of sinker throats and position such base yarns 60 in line with or inwardly with respect to the loop 64 (see FIG. 8) preparatory to the formation of stitches as required for regular plating the loop and base yarns, that is for causing the loop yarn to appear on one side of the fabric and base yarn on the other.

An alternative to the integral camming portion for use in effecting regular plating is an adjustable plating cam 90 as shown in FIG. 6 on a sinker cam segment 92. Such plating cam has the advantage that it can be used not only for regular plating but also for reverse plating in which the loop yarn is caused to appear on both sides of the fabric. The cam 90 is adjustable relative to screws 94 and 96 which extend through a slot 98 in the adjustable cam and into the sinker cam segment 92. The plating cam is affixed to the cam segment merely by tightening the screws. In FIG. 6 the plating cam is shown in position for controlling the sinkers in the same manner as the integral camming portions 84, 86 and 88, that is to produce regular plating. For reverse plating the cam 90 is positioned to align edge 100 with inside edge 102 of the cam segment 92. Sinkers therefore move across the cam without being moved inwardly as when the cam is disposed for regular plating.

A sinker 104 particularly suited for reverse plating is shown in FIG. 9. The sinker is moved to engage a base yarn 106 in throat 108 and position such yarn to the outside of the loop yarn 110 preparatory to the formation of a stitch as required for reverse plating, rather than in line with or to the inside of the loop yarn and next to the needle as in regular plating, and as shown the sinkers includes an inclined top edge 112 extending downwardly from an uppermost edge 114 above upper and lower knitting edges 116 and 118 respectively and an upper throat 120 which further assures proper positioning of the loop yarn 110 relative to the base yarn 106 as a needle is lowered relative to the sinker during stitch formation.

Although the invention has been described in its preferred forms, with a certain degree of particularity, it is understood that the present disclosure of the preferred forms has been made by way of example and the numerous changes in the details of construction and the combination and arrangement of parts may be resorted to without departing from the spirit and the scope of the invention.

Having thus set forth the nature of the invention, what is claimed herein is:

1. In a circular knitting machine for forming loop fabric the combination comprising a plurality of sinkers each with a nib, an upper knitting edge extending to the nib and a lower knitting edge below the nib, a plurality of latch type needles alternating between adjacent sinkers, means for moving needles between a latch clear and a cast-off position, means for feeding loop yarns above the upper knitting edge of the sinkers and base yarns below the sinker nibs, means for moving the sinkers in one direction to a position such that long loops may be formed over said upper knitting edge of the sinkers while base yarn is knit over the lower knitting edge and for moving the sinkers in the opposite direction thereby freeing the long loops from the sinker nibs, means for holding the fabric above the said lower knitting edge of the sinkers and each sinker nib having an edge extending downwardly from its upper knitting edge such that when a sinker is moved in the said one direction the sinker nib re-enters previously formed loops of the fabric held above the lower knitting edge causing them to ride up the nib whereby such loops are stretched and straightened.

2. The combination of claim 1 wherein the cylinder receives the sinkers in grooves the depth of which is greater than the height of the sinker blades, and said means for holding the fabric at the sinkers is a surface of the cylinder extending above the first knitting edge of the sinkers.

3. The combination of claim 1 wherein the means for holding the fabric at the sinkers is a ring which is fixed relative to the cylinder.

4. The combination of claim 1 wherein the nib of each sinker extends downwardly from the upper knitting edge and includes a tapered end portion.

5. The combination of claim 1 wherein the means for moving the sinkers includes a cam ring and adjustable plating cams, the plating cams being provided to move the sinkers to extreme positions in said one direction for regular plating.

6. The combination of claim 1 wherein each sinker includes a blade which defines the lower knitting edge and which is separated from the nib of the sinker by a throat having a closed inner end, and said sinker includes a third edge above the said upper knitting edge and an inclined edge extending from the said third edge to a point over the upper knitting edge located outwardly on the sinker with respect to the inner end of the throat.

7. The combination of claim 6 wherein the means for moving the sinkers is a cam ring which positions the sinkers in said one direction for reverse plating.

8. The combination of claim 1 wherein the sinkers are positioned by the sinker moving means to cause at least one loop of cloth to be supported on the upper edge of the sinker while a new loop is formed over such upper edge.

* * * * *